United States Patent [19]

Callicoatte

[11] 4,390,326

[45] Jun. 28, 1983

[54] DOWNHOLE PUMP HAVING A POWER PISTON AND A PRODUCTION PISTON

[76] Inventor: Jerry D. Callicoatte, 3206 W. Shandon, Midland, Tex. 79701

[21] Appl. No.: 220,816

[22] Filed: Dec. 29, 1980

[51] Int. Cl.[3] ..... F04B 47/08

[52] U.S. Cl. ..... 417/401; 417/390

[58] Field of Search ..... 417/377, 378, 398, 399, 417/401, 487, 390

[56] References Cited

U.S. PATENT DOCUMENTS

| | | | |
|---|---|---|---|
| 1,941,453 | 1/1934 | Whittington | 417/402 |
| 1,946,723 | 2/1934 | Thompson | 417/378 |
| 2,286,926 | 6/1942 | Parenti | 417/402 X |
| 2,508,609 | 5/1950 | Johnston | 417/378 |
| 3,103,175 | 9/1963 | Humphrey | 417/401 |

*Primary Examiner*—Leonard E. Smith
*Attorney, Agent, or Firm*—Marcus L. Bates

[57] ABSTRACT

A fluid actuated pumping system for producing fluid from a subsurface reservoir through a wellbore communicating therewith. A conduit extends from the surface, downhole to the pump. The pump includes an inner piston reciprocatingly received within an inner barrel, an annular piston reciprocatingly received within an outer barrel, and energy storage means connected to the pistons by which energy is stored when one of the pistons is forced to move downhole. The inner piston divides the inner barrel into an upper and lower chamber, and check valve means associated therewith enables reciprocation of the piston to cause one way flow to occur into the lower chamber, and from the lower chamber into the upper chamber, where the liquid is lifted through the conduit and to the surface of the ground. The conduit is also flow connected to the annular piston so that when fluid pressure is applied thereto, both pistons are forced in a downhole direction to store energy. When the pressure is relieved, the energy storage device forces both the pistons in an uphole direction, thereby producing fluid.

10 Claims, 8 Drawing Figures

DOWNHOLE PUMP HAVING A POWER PISTON AND A PRODUCTION PISTON

BACKGROUND OF THE INVENTION

It is notoriously old in the art to reciprocate a downhole piston by utilizing a string of sucker rod in order to provide power by which fluid is lifted from a downhole fluid producing formation and uphole to the surface of the ground. It is also notoriously old in the art to use a continuous flow of fluid connected to a downhole hydraulic pump by means of a fluid conduit. Both of these pumping techniques include either a string of sucker rod or a separate power oil tubing string.

Hydraulically actuated downhole pumps of the type heretofore known have required a separate power oil string which extends downhole to the hydraulically actuated pump, and often a production string which leads back uphole to the surface of the ground through which the spent power fluid and the produced fluid flows. The present invention differs from the prior art in that the conduit leading downhole to actuate the downhole pump is also the conduit through which the produced fluid and spent power fluid return uphole to the surface of the ground. Such a pump is the subject of the present invention.

THE PRIOR ART

Tobin, U.S. Pat. No. 1,304,411
Shutt, U.S. Pat. No. 1,765,457
Cheverha, U.S. Pat. No. 2,014,613
Dickinson, U.S. Pat. No. 2,075,428.
Hardey, U.S. Pat. No. 2,376,538
Leinweber, U.S. Pat. No. 2,406,229
Dickinson, U.S. Pat. No. 2,490,118
Lewis, et at., U.S. Pat. No. 2,539,846
Sundstrom, U.S. Pat. No. 2,664,825

The above prior art does not disclose the pump claimed herein.

SUMMARY OF THE INVENTION

A fluid actuated pump apparatus adapted to be placed downhole in a borehole, in order to produce fluid from a subsurface formation. A conduit cyclicly conducts the flow of power fluid downhole to the pump, and also provides the conduit through which produced fluid flows from the formation, into the pump, and up to the surface of the ground. Hence, power fluid and produced fluid alternately flow in countercurrent directions through the conduit.

In particular, the fluid actuated pump of the present invention includes an inner and outer barrel, respectively, having an inner and outer piston, respectively, reciprocatingly received therewithin. The inner and outer pistons are connected together to concurrently reciprocate in the respective barrels. Energy storage means is connected to the pistons so that when the pistons are forced downhole, energy is stored therewithin. This feature enables one of the pistons to subsequently utilize the stored energy to lift fluid from the formation to the surface of the ground.

In one embodiment of the invention, fluid flow occurs along a fluid flow path down to the upper end of the outer barrel so that when fluid pressure is effected upon the outer piston, the outer piston moves downwardly thereby storing energy while concurrently moving the inner piston downwardly.

Fluid from the formation is transferred from below the inner piston into the upper marginal end of the inner barrel. Fluid pressure on the outer piston is released, thereby releasing the stored energy and forcing both pistons uphole. This action causes the inner piston to lift the fluid from the upper end of the barrel back up through the same flow path through which the power fluid was effected so that both spent power fluid and formation or produced fluid flows to the surface of the ground.

In a more specific embodiment of the present invention, the inner and outer barrels are concentrically arranged respective to one another. The outer piston is in the form of an annulus which sealingly engages the outer surface of the inner barrel and the inner surface of the outer barrel. The upper face of the outer annular piston is exposed to a conduit leading uphole to the surface of the earth. The inner piston has a traveling valve associated therewith, and divides the inner barrel into an upper and lower chamber. The upper and lower chambers include one way check valves, and as the inner piston reciprocates within the inner barrel, fluid is transferred from the formation into the lower barrel, through the piston, into the upper barrel, and back up through the conduit to the surface of the ground. Hence, alternate countercurrent flow of power fluid and produced fluid occurs through the same conduit.

Provision is made for cyclicly applying pressure to the conduit which leads downhole to the pump assembly. The pressure applied to the conduit is of a sufficient magnitude to force the annular piston downhole, thereby storing energy. When the conduit pressure is relieved, the force of the stored energy is sufficient to force both pistons uphole thereby lifting fluid up through the conduit and to the surface of the ground. The spent power fluid is returned each cycle of operation.

The energy storage device preferably is in the form of a coil spring. In one embodiment of the invention, the coil spring is located uphole of the pump assembly, and one end is connected to the side of the wellbore, and the other end to a piston rod connected to one of the pistons, thereby placing the spring in tension when energy is stored therein. In another form of the invention, the coil spring is located below the annular piston and placed to be compressed as the annular piston is reciprocated downhole to store energy within the compressed spring.

Accordingly, a primary object of the present invention is the provision of a downhole fluid actuated pump which produces formation fluid through the same conduit through which power fluid is effected upon the pump.

Another object of the present invention is the provision of a pumping system for a subsurface fluid producing formation which utilizes two pistons in such a manner that one of the pistons is reciprocated to store energy and thereafter the stored energy is utilized to reciprocate both pistons in an uphole direction thereby lifting fluid to the surface of the earth.

A further object of this invention is the provision of a pumping system having means for cyclicly applying pressure to a conduit, wherein the conduit is utilized to flow power fluid downhole towards a pump assembly, while spent power fluid and produced fluid flow back up through the same conduit to the surface of the ground in a cyclic manner.

Another and still further object of the present invention is the provision of a downhole pump assembly having concentrically arranged pistons reciprocatingly received within concentrically arranged barrels, wih the pistons being connected together and concurrently reciprocating. The pistons are connected to an energy storing apparatus. Power fluid flows into the same conduit to store energy that produced fluid subsequently flows back through and to the surface of the ground.

An additional object of the present invention is the provision of a downhole pump apparatus having concentrically arranged pistons connected to one another and reciprocatingly received in concentrically arranged pump barrels, with one of the pistons being connected to a conduit so that flow through the conduit forces both the pistons downhole to store energy, and thereafter both pistons are forced uphole by the stored energy so that one of the pistons can produce fluid through the same mentioned conduit.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
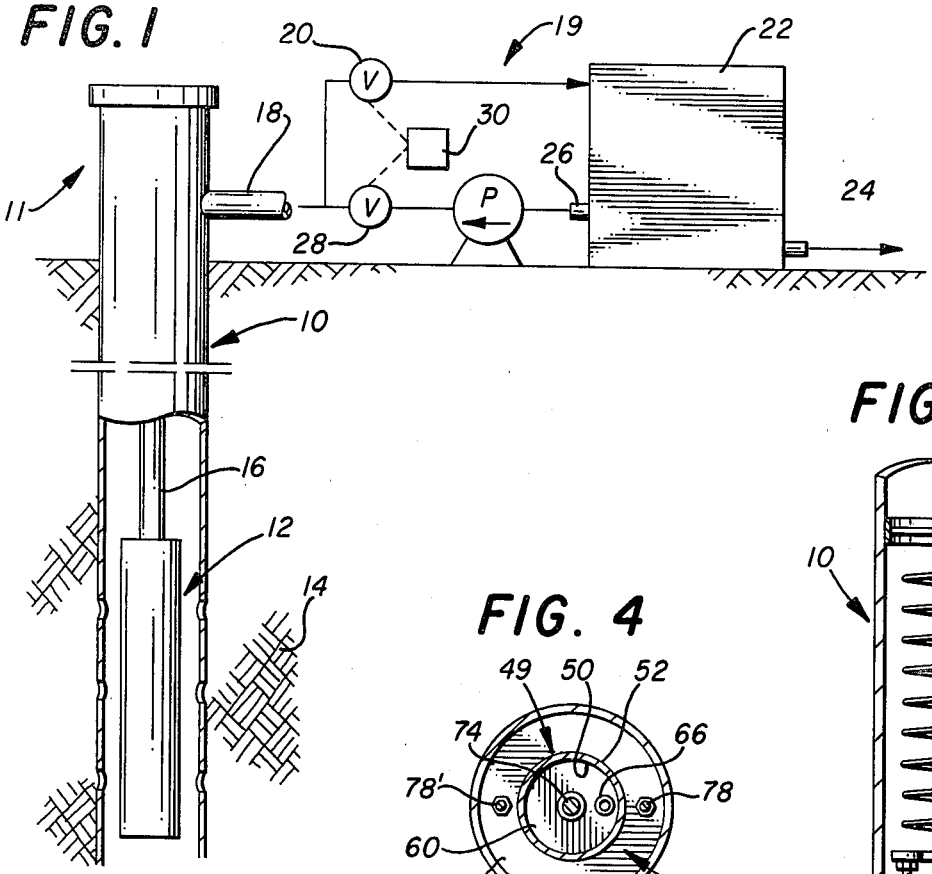
FIG. 1 is a part diagrammatical, part schematical, part cross-sectional, side elevational view of the present invention in combination with a wellbore.

FIG. 1 discloses a cased borehole 10 extending uphole to the surface of the ground and terminating in a wellhead 11. A downhole pump 12, made in accordance with the present invention, produces fluid from a fluid bearing formation 14. Production pipe 16 connects the pump to an outflow line 18.

Numeral 19 indicates a flow control system by which the downhole pump is operated. The flow control system includes a valve 20 through which flow occurs from outlet 18 into tank 22. Outlet nipple 24 provides means for utilizing the fluid contained within the tank. Outlet 26 is connected to the illustrated pump P which in turn provides a fluid pressure source to a valve 28. The last named valve is connected to outlet 18 of the wellhead.

Apparatus 30 is a controller by which valve 28 is opened while valve 20 is closed, and vice versa. Therefore, valve 20 preferably is a normally opened valve, while valve 28 is a normally closed valve, with each of the valves being concurrently actuated by a solenoid or the like. Moreover, apparatus 30 additionally includes a timer device by which this cyclic operation occurs in a predetermined time cycle.

Figure 2:
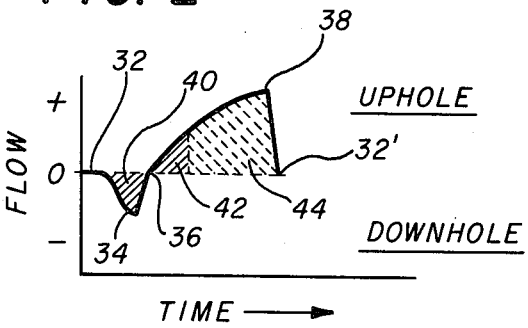
FIG. 2 is a plot showing one cycle of operation of the apparatus disclosed in FIG. 1.

In FIG. 2, there is set forth a curve which describes the flow characteristics of the pumping system of the present invention. Numeral 32 indicates the beginning of one of a series of cycles of operation. Flow occurs downhole through conduit 16 as noted by the curve 34. The flow terminates and is reversed at 36 which is also the zero portion of the curve. Flow occurs uphole through the same conduit 16, with the flow continuing until it is terminated at 38, and rapidly dies to zero at 32'. Numeral 40 is the quantity of power fluid pumped downhole, while numeral 42 together with numeral 44 indicates the quantity of fluid which flows back uphole through flow conduit 16. The area 40 is equal to the area 42 and therefore, the area 44 indicates the profit or the actual production realized from one cycle of operation of the pump of the present invention.

Figure 3:
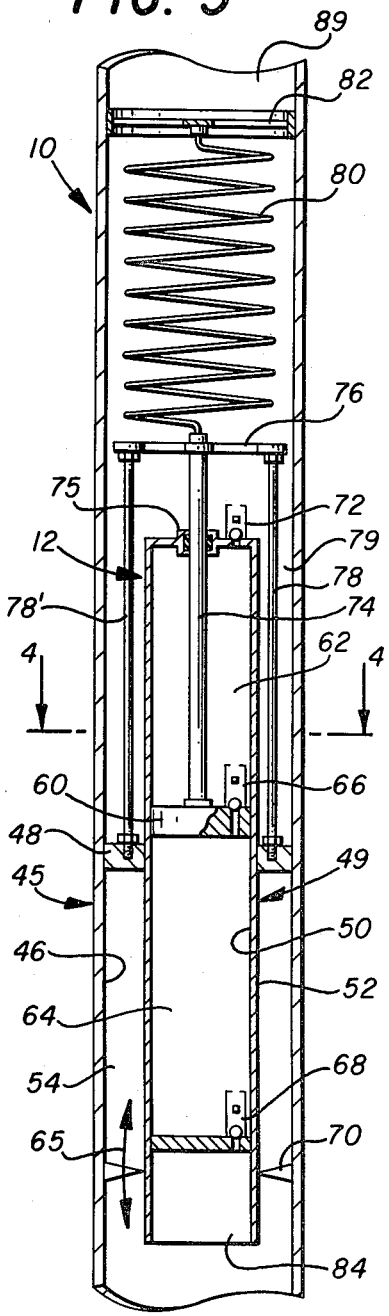
FIG. 3 is an enlarged, fragmentary, diagrammatical, representation of part of the apparatus disclosed in FIG. 1.

In FIG. 3, there is disclosed one form of the pump 12, which includes an outer pump barrel 45 having a smooth inside surface 46 against which an annular piston 48 is reciprocatingly received in a sealed manner. An inner pump barrel 49 is concentrically arranged respective to the outer pump barrel and includes a smooth inner surface 50 and smooth outer surface 52.

Figure 4:
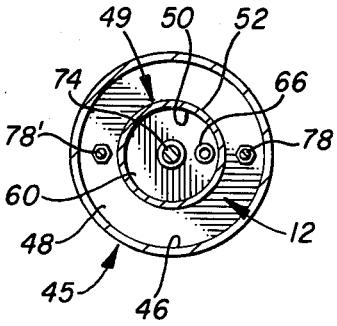
FIG. 4 is a cross-sectional view taken along line 4-4 of FIG. 3.
Figure 5:
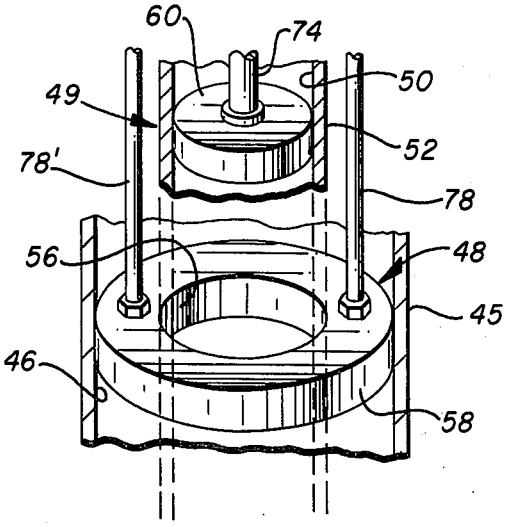
FIG. 5 is an enlarged, part cross-sectional, fragmentary view of part of the apparatus disclosed in FIG. 3.

As seen in FIGS. 3-5, the annular piston reciprocates within annulus 54 and has an inside diameter 56 and an outer diameter 58. The i.d. sealingly engages surface 52 of the inner barrel, while the o.d. sealingly engages the surface 46 of the outer barrel.

Looking again now to FIG. 3, it will be noted that an inner piston 60 divides the inner barrel into an upper production chamber 62 and a lower production chamber 64. Check valves 66, 68, and 72 permit one way flow to occur from the formation into the chamber 64, from chamber 64 through the piston, and into chamber 62, where the fluid is lifted to the surface of the ground as is easily comprehended by those skilled in the art. The check valves preclude the reverse flow of fluid.

Numeral 65 indicates flow of fluid into and out of annulus 54 as the annular piston reciprocates within the outer pump barrel.

Stabilizer 70 anchors the inner pump barrel to the outer pump barrel so that there is no movement therebetween. The outer pump barrel can be an extension of the casing of the borehole, or alternatively, the upper end of the outer pump barrel can be reduced in diameter and connected to a fluid conduit such as the tubing seen at 16 in FIG. 1.

The inner piston includes a production piston rod 74 which extends through packing gland 75. The upper end of the rod is connected to cross member 76. The cross member is connected to radially spaced apart annular piston rods 78, which in turn have the lower end thereof connected to the annular piston. The cross member is also connected to an energy storage device 80, which preferably is in the form of a metal spring. One end of the spring is connected to the cross member, while the other end of the spring is connected to a spring hanger 82. The spring hanger can be any anchored device which does not substantially interfere wih fluid flow thereacross. Similarly, the cross member 76 can be a cantilever arm which does not substantially interfere with flow thereacross. Numeral 84 broadly indicates the inlet end of the inner barrel, which is arranged to receive formation fluid thereinto.

Figure 6:
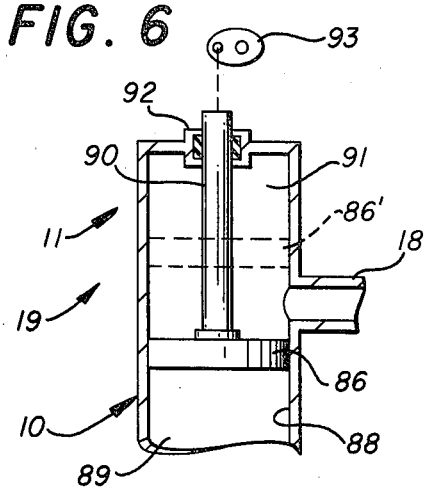
FIG. 6 discloses an alternant embodiment of part of the apparatus disclosed in some of the foregoing figures.

In FIG. 6, a power fluid system 19 is set forth. The system includes a power piston 86 reciprocatingly received within a cylinder 88. The cylinder can be a polished portion of the upper marginal end of either a tubing 16 or a casing 10, depending upon the manner in which the downhole pump is connected for flow. The piston therefore divides the power cylinder 88 into a lower chamber 89 and an upper chamber 91. Piston shaft 90 extends through packing gland 92 and to means 93 for imparting reciprocatory motion into the shaft 90. Cylinder chamber 89 is in communication with the annular piston, and with the flow from check valve 72.

As the piston 86 is reciprocated by shaft 90, the piston passes outlet 18, thereby forcing fluid at 89 in a downhole direction and towards the pump, thereby forcing the annular piston to store energy at 80. As the piston is reciprocated uphole into the position 86', fluid is free to flow from the pump chamber 62, uphole, and through the outlet 18.

Figure 7:
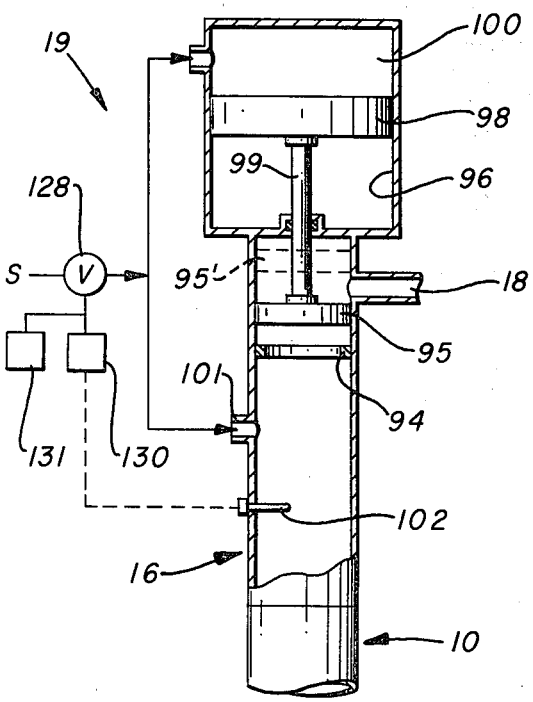
FIG. 7 is a diagrammatical illustration which sets forth still another embodiment of part of the apparatus of the present invention; and, FIG. 8 is a broken, side elevational view of another embodiment of the present invention.

In FIG. 7, a valve seat 94 is located near the upper marginal end of the fluid conduit 10 or 16. Valve element 95 precludes fluid flow through the seat when the element is sealingly received thereagainst, and enables flow to occur through the seat and through outlet 18 when the valve element is moved into position 95'. Cylinder 96 reciprocatingly receives piston 98 is sealed relationship therewithin. Piston rod 99 interconnects upper piston 98 with lower piston 95. Therefore, piston 98 divides the cylinder 96 into an upper chamber 100 and the illustrated lower chamber 96.

Flow conduit 10 is flow connected to nipple 101, which in turn is connected to a valve 128 and to the chamber 100. Valve 128 is also connected to the illustrated source of fluid pressure. The valve is closed by solenoid 130 when the pressure sensor 102 indicates a predetermined elevated pressure within the conduit 16. Timer apparatus 131 sequentially opens the valve in a cyclic manner.

Figure 8:
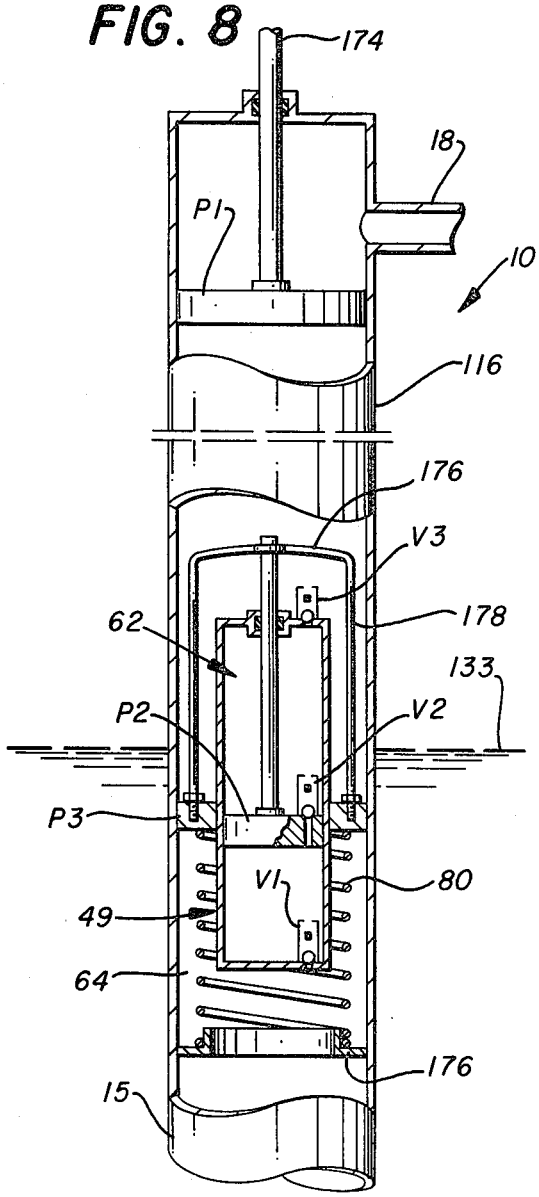

In FIG. 8, the energy storage means 80 is in the form of a coil spring which is captured between the annular piston P3 and a circumferentially extending hanger 176, so that the spring 80 is compressed when power fluid piston P1 moves downhole towards the pump. The fluid level 133 is above the pumping intake. Valves VI, V2, and V3 enable reciprocation of the inner piston P2 to move fluid up through the conduit 116. Annular piston P3 sealingly engages the annulus formed between the outer and inner pump barrels 15 and 49.

In operation, the pump is located downhole in the manner of FIG. 1, and power fluid is cyclicly effected upon the production tubing, thereby causing the annular piston to reciprocate in a downhole direction. Check valve 72 precludes reverse fluid flow into upper working chamber 62. Accordingly, annulus 79 acts as a cocking chamber. As the annular piston is forced to reciprocate downhole, fluid is transferred at 65 from annulus 54 into the borehole annulus. At the same time, piston 60 moves concurrently with piston 48, causing fluid to be transferred from lower chamber 64 into upper chamber 62. After the pressure at 89 has been reduced, the energy storing apparatus 80 forces the cross member 76 in an upward direction, reciprocating piston 60 uphole within the inner barrel, thereby lifting fluid through check valve 72 and uphole towards outlet 18. At the same time, fluid contained within annulus 79 is lifted uphole. The net gain in the produced fluid is the fluid moved by piston 60. The relative areas of the pistons and spring force along with the piston stroke determines the quantity of power fluid and produced fluid.

The above operation is exemplified by FIG. 2 wherein the power fluid flow downhole is represented by area 40. Area 42 indicates the fluid flow uphole occasioned by upward movement of the annular piston. Since the piston reciprocates uphole and downhole the same amount, area 40 must equal area 42. Area 44 indicates the fluid produced by the action of piston 60. Accordingly, the flow downhole is indicated by area 40, the total flow through outlet 18 is indicated by areas 42 plus 44, and the actual produced fluid is represented by area 44.

In the operation of the control apparatus set forth in the embodiment disclosed in FIG. 1, the pump 12 is cocked by valve 28 opening and valve 20 concurrently closing, whereupon pump P forces fluid at 18 into production tubing 16, and downhole to the pump, whereupon the pistons travel downhole and store energy. Apparatus 30 opens valve 20 and closes valve 28, thereby permitting the stored energy to move both pistons back uphole, thereby lifting fluid such that flows occurs up through production tubing 16, outlet 18, valve 20, and into the storage tank 22.

In the embodiment set forth in FIG. 6, the control apparatus 19 comprises a piston 86 which reciprocates from an uppermost position 86' to a lowermost position located a considerable distance below outlet 18. This action forces fluid at 89 downhole to a store energy within apparatus 80. As the piston 86 moves uphole to a position 86', the stored energy lifts both pistons, 48 and 60, uphole thereby producing fluid which flows through flow line 18. Apparatus 93 can be a pumpjack, or other means for imparting reciprocatory motion into shaft 90.

In the embodiment set forth in FIG. 7, the pump 12 of FIG. 1 is actuated by flow which occurs from source S, through valve 128, into nipple 101, where flow occurs downhole to the pump and stores energy. As flow occurs through valve 128, it concurrently flows into chamber 100 causing piston 98 to reciprocate in a downward direction. Shaft 99 closes valve element 95 against valve seat 94 to preclude flow of fluid across the seat. This causes flow from S to occur downhole. After the pressure has been released by opening of valve 95, which causes the closure of valve 128, the stored energy forces piston 95 in an upward direction until the piston clears outlet 18, as indicated by the dot-dash lines at 95'. The pistons 48 and 60 of the pump lift fluid up through the conduit, through outlet 18, and to the gather system.

Sensor 102 actuates valve closure means 130 to close valve 128 when a predetermined pressure is effected within the production tubing. Timer 131 opens valve 128 on a predetermined time cycle to provide a curve similar to FIG. 2.

The fluid pressure source of FIG. 7 can be compressible or non-compressible fluids. Air, gas, crude oil, or water can be flowed at 101 in order to cock the annular pistons.

In some instances, the casing gas pressure can be connected to valve 128 as a source of power fluid. Sometimes it may be necessary to boost the casing gas pressure to a suitable value.

In many instances, it is advantageous to employ gas rather than liquid as the power fluid because the production fluid is often cut with gas, which brings about a condition referred to as fluid pounding, wherein a downhole pump reciprocates but is unable to pump the formation fluid to the surface of the earth.

I claim:

1. In a pumping apparatus, an inner pump barrel, an outer pump barrel, an annular piston reciprocatingly received within said outer pump barrel, an inner piston reciprocatingly received within said inner pump barrel, means by which said annular piston is directly connected to be moved concurrently with said inner piston; energy storage means connected to store energy when one of said inner and annular piston are moved in a downward direction;

a fluid conduit connected to effect fluid pressure on said annular piston; said inner piston divides said inner barrel into a lower and upper chamber, check valve means by which reciprocation of said inner piston causes fluid to flow into said lower chamber and from said lower into said upper chamber and from said upper chamber into said fluid conduit;

so that when fluid pressure is effected in one direction within said fluid conduit, said annular piston is forced to reciprocate and store energy, and when said fluid pressure is reduced, the stored energy forces the inner piston upwards thereby producing fluid which flows in another direction within said fluid conduit.

2. The apparatus of claim 1 wherein said inner and outer pump barrels are concentrically arranged respective to one another to provide an annulus therebetween; said annular piston is sealingly received within said annulus.

3. The apparatus of claim 1 wherein said energy storage means is a spring arranged to be placed in tension when said annular piston moves in a downhole direction.

4. The apparatus of claim 1 wherein said fluid conduit is cyclically connected to a source fluid under pressure to force said pistons in a downhole direction; and, said energy storage means is a coil spring arranged to be placed in compression when said annular piston moves in a downhole direction.

5. A fluid actuated pump apparatus adapted to be placed downhole in a borehole; said pump apparatus includes an outer and an inner barrel, a single fluid conduit connected to provide a flow path to each said barrel, an inner piston reciprocatingly received within said inner barrel and dividing the inner barrel into an upper and lower working chamber, check valve means by which fluid may be forced to flow into said lower barrel, from said lower into said upper barrel, and up said conduit;

an annular piston reciprocatingly received within said outerbarrel, means by which said inner piston is directly connected to said outer piston for movement concurrently therewith, energy storage means by which energy is stored when the pistons are moved downwardly;

means for applying fluid pressure to said conduit to reciprocate said annular piston, thereby storing energy in said energy storage means while concurrently reciprocating said inner piston downward within said inner barrel; and, means for removing the applied fluid pressure to enable the stored energy to reciprocate the pistons upward to thereby force fluid up said conduit.

6. The pump apparatus of claim 5 wherein said inner and outer pump barrels are concentrically arranged respective to one another to provide an annulus therebetween; said annular piston is sealingly received within said annulus;

said fluid conduit is cyclically connected to a source of fluid under pressure to force said pistons in a downhole direction; and, said energy storage means is a coil spring arranged to be placed in compression when said annular piston moves in a downhole direction.

7. The pump apparatus of claim 5 wherein said inner and outer pump barrels are concentrically arranged respective to one another to provide an annulus therebetween; said annular piston is sealingly received within said annulus;

said energy storage means is a spring arranged to be placed in tension when said annular piston moves in a downhole direction.

8. A fluid actuated pumping system for producing liquid from a subsurface reservoir up through a wellbore communicating therewith, the combination comprising a casing in the wellbore, a conduit in the casing spaced therefrom to form an annular passageway therewith, a downhole pump connected to the lower end of the conduit;

said downhole pump includes an inner barrel spaced from an outer barrel, an inner piston reciprocatingly received within and dividing the inner barrel into an upper and a lower working chamber, an annular piston reciprocatingly received within the annulus formed between the inner and outer barrels;

first check valve means for one way flow of formation fluid into said lower working chamber, second check valve means for one way flow of fluid from said lower into said upper working chamber, third check valve means for one way flow of fluid from said upper working chamber into said conduit;

means directly connecting said inner and annular pistons for concurrent reciprocation thereof, energy storage means connected to said pistons for storing energy on the downstroke and releasing energy on the upstroke thereof;

means connecting said conduit to said annular piston for reciprocating said annular piston in a downhole direction when fluid pressure is applied to said conduit; so that energy is stored in said energy storage means;

whereby fluid flow downhole stores energy for forcing said pistons uphole, thereby enabling power fluid to occur downhole through the conduit, while produced and spent power fluid flows uphole through said conduit.

9. The combination of claim 8 wherein said inner and outer pump barrels are concentrically arranged respective to one another to provide an annulus therebetween; said annular piston is sealingly received within said annulus;

said fluid conduit is cyclically connected to a source of fluid under pressure to force said pistons in a downhole direction; and, said energy storage means is a coil spring arranged to be placed in compression when said annular piston moves in a downhole direction.

10. The combination of claim 8 wherein said inner and outer pump barrels are concentrically arranged respective to one another to provide an annulus therebetween; said annular piston is sealingly received within said annulus;

said energy storage means is a spring arranged to be placed in tension when said annular piston moves in a downhole direction.

* * * * *